United States Patent [19]

Holmes et al.

[11] 4,188,068

[45] Feb. 12, 1980

[54] APPARATUS FOR MIXING GAS AND LIQUID AT A DOWNHOLE LOCATION

[75] Inventors: Billy G. Holmes, Lancaster; Jimmie Crofford, Arlington, both of Tex.

[73] Assignee: Mobil Oil Corporation, New York, N.Y.

[21] Appl. No.: 896,829

[22] Filed: Apr. 17, 1978

[51] Int. Cl.[2] ..... E21B 23/28

[52] U.S. Cl. ..... 299/5; 261/119 R

[58] Field of Search ..... 261/119 R; 299/4, 5; 166/202, 203, 242, 241

[56] References Cited

U.S. PATENT DOCUMENTS

| | | | |
|---|---|---|---|
| 3,566,963 | 3/1971 | Blackledge | 166/202 |
| 3,734,179 | 5/1973 | Smedley | 166/106 |
| 3,826,742 | 7/1974 | Kirk et al. | 261/119 R |
| 4,068,713 | 1/1978 | McGuire | 166/223 |

*Primary Examiner*—William F. Pate, III

*Attorney, Agent, or Firm*—C. A. Huggett; Drude Faulconer

[57] ABSTRACT

Apparatus for mixing a gas, e.g., oxygen, and a liquid, e.g., leach solution, at a downhole location in a well for treating a formation, e.g., in situ leaching of uranium. The apparatus comprises a mixing means which is adapted to be affixed to the lower end of the gas supply conduit and is lowered into and raised out of the well by means of the conduit. The mixing means is comprised of a solid, noncorrosive plate having a central opening into which the gas conduit is secured. The plate has a plurality of additional openings surrounding the central opening and has a gasket thereon to form a seal between the plate and the well bore. Liquid is flowed down the well and passes through the additional openings in the plate. At the same time, gas is supplied through the conduit and flows through the central opening in the plate. Due to the increased velocity of the liquid caused by the liquid as it flows through the additional openings in the plate, the gas is trapped to form a gas pocket below the plate. Liquid flows through the gas pocket and thereby becomes saturated with the gas.

5 Claims, 4 Drawing Figures

FIG. 1
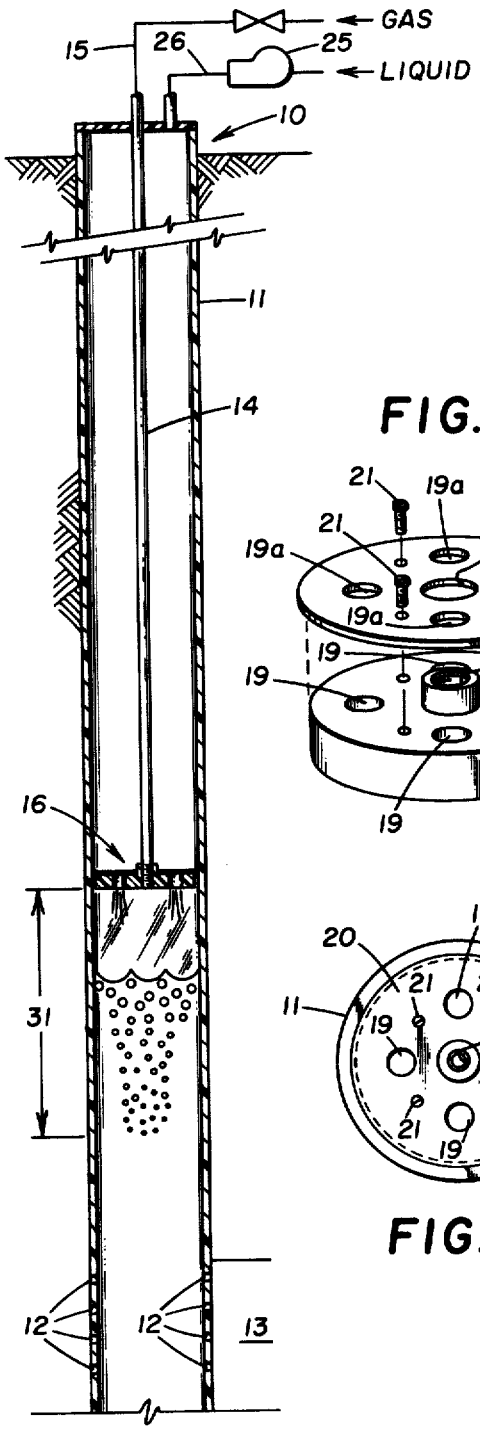
FIG. 4
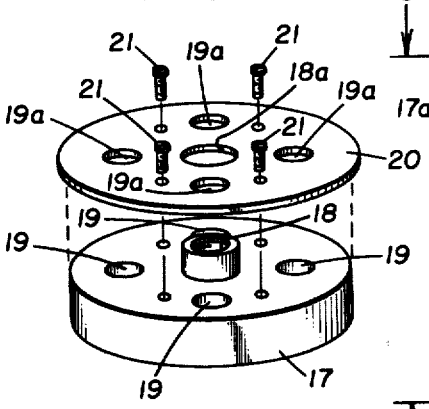
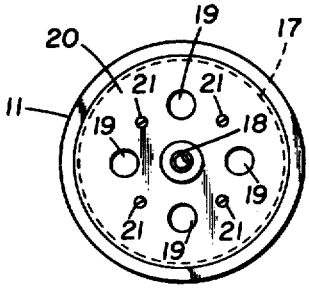
FIG. 3
FIG. 2
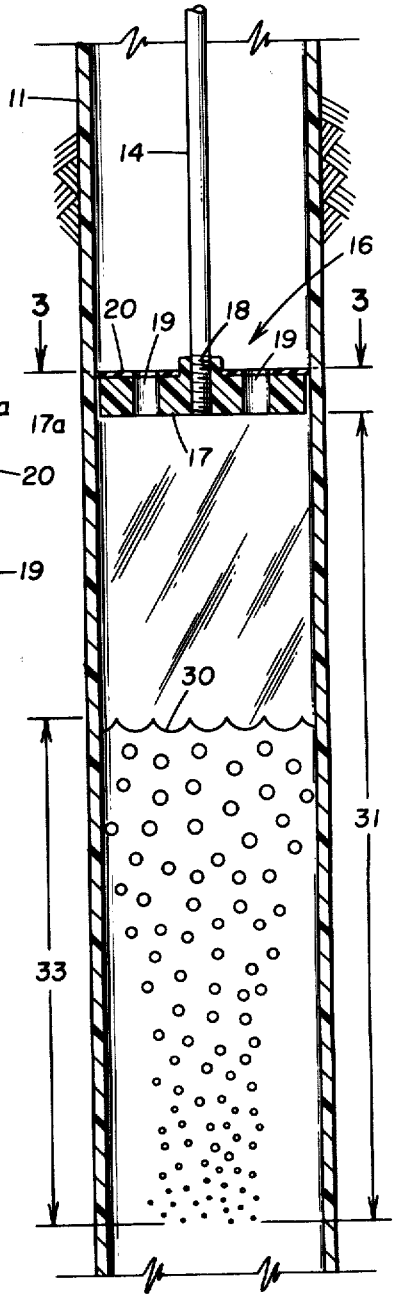

APPARATUS FOR MIXING GAS AND LIQUID AT A DOWNHOLE LOCATION

BACKGROUND OF THE INVENTION

The present invention relates to an apparatus for mixing a gas and a liquid at a downhole location and more particularly relates to an inexpensive mixing apparatus for saturating a liquid with a gas at a downhole location wherein the mixing apparatus can easily be run into and out of a well.

In producing minerals from a subterranean formation, there are instances where the formation requires treatment with a gas-saturated liquid. For example, in a typical in situ leach operation, wells are completed into a leachable, mineral-bearing formation, and a leach solution is flowed between wells to dissolve the mineral values into the leach solution. The pregnant leach solution is produced to the surface where it is treated to recover the mineral values from the leach solution.

Many leachable mineral values, as they occur in their natural state in a formation, must be oxidized to a higher valence before they become soluble into a leach solution. For example, uranium is normally present in a formation in the tetravalent state and must be oxidized to the hexavalent state to render it soluble in a suitable leach solution, e.g., an aqueous carbonate solution. To oxidize uranium to its higher valence, it is customary to contact the uranium in the formation with an oxidant which may be injected directly into the deposit or which may be mixed into the leach solution and injected therewith.

Several oxidants have been proposed for this purpose, including gaseous oxidants such as air and oxygen. For example, in U.S. Pat. No. 3,708,206, oxygen is injected into a formation prior to or simultaneously with a leach solution. In U.S. Pat. No. 3,713,698, air is injected through a production well to oxidize uranium values prior to injecting a leach solution through an injection well. In both U.S. Pat. Nos. 3,640,579 and 3,860,289, oxygen is supplied through a tube to a downhole location where it is bubbled into a leach solution before the leach solution is injected into a formation.

With each of these types of injection schemes, excess quantities of oxygen are required to dissolve a sufficient amount of oxygen into the leach solution. For example, where oxygen is merely bubbled into the leach solution downhole before the leach solution enters the formation, experimentation suggests that a tenfold to fifty-fold excess of oxygen over the saturation requirement is needed to bring the leach solution to a level of 80% oxygen saturation, resulting in excessive oxygen costs.

Therefore, it has been proposed to mix the gas such as oxygen and liquid such as leach solution at a downhole location in such a manner that the liquid is substantially fully saturated with little or no excess gas being required. Methods and apparatuses for mixing gas and liquid at a downhole location in this manner are fully disclosed in copending U.S. applications Ser. Nos. 846,863 and 846,874, both filed Oct. 31, 1977. While the apparatuses disclosed in these copending applications perform satisfactorily to accomplish their tasks, both are relatively expensive to construct and relatively difficult to install.

SUMMARY OF THE INVENTION

The present invention provides an inexpensive apparatus of rugged but simple construction for mixing a gas and a liquid at a downhole location in a well which can easily be installed into and removed from the well.

More specifically, the present invention comprises a solid circular plate having a diameter slightly less than that of the well in which it is to be lowered. The plate has a central opening therethrough adapted to be affixed to the lower end of a small diameter conduit which is to supply gas to the downhole location. The conduit also provides the means by which the mixing apparatus is easily lowered into or removed from the well.

The plate has a plurality of additional openings therethrough which surround the central opening. A gasket having a diameter substantially the same as that of the well is secured to the plate to provide a sealing means between the plate and the wellbore. Openings are provided through the gasket in alignment with the openings in the plate.

In operation, the mixing apparatus is affixed to the gas conduit and lowered into position in the well. Liquid is flowed down the annulus formed between the wall of the well and the gas conduit and through the additional openings in the plate, thereby substantially increasing its flow velocity. At the same time, gas is flowed down the conduit and exits through the central opening in the plate in the form of bubbles. The increased velocity of the liquid as it passes through the plate increases the drag force on the bubbles as they attempt to rise in the liquid and the pressure drop across the openings in the plate reduces the effective buoyant force of the bubbles in the liquid. Together, these effects along with the seal means provided by the gasket prevent the bubbles from passing upward through or around the plate thereby causing the bubbles to be trapped to form a gas pocket in a mixing zone below the plate.

Working on the principle similar to that of a venturi scrubber or mixer, the liquid flows through the gas pocket in the form of "waterfalls" with gas bubbles becoming entrapped in the liquid. Part of the gas is dissolved into the liquid as the bubbles are formed, with some free gas being carried from the pocket by the liquid. A column of froth is created in the mixing zone by the "waterfalls" as the liquid exits the gas pocket. This froth column provides extremely high interfacial surface area and liquid turbulence thereby further promoting mass transfer of additional gas to the liquid.

BRIEF DESCRIPTION OF THE DRAWINGS

The actual construction, operation, and the apparent advantages of the present invention will be better understood by referring to the drawings in which like numerals identify like parts and in which:

FIG. 1 is an elevational view, partly in section, of the present invention, in position in a well;

FIG. 2 is an enlarged sectional view of the lower end of the well in FIG. 1;

FIG. 3 is a sectional view taken along sectional line 3—3 of FIG. 2; and FIG. 4 is an exploded, perspective view of the mixing apparatus of the present invention.

DESCRIPTION OF THE PREFERRED EMBODIMENT

Referring more particularly to the drawings, FIG. 1 discloses an injection well which is fused to inject a gassaturated liquid into a formation during a treating operation. For example, a gaseous oxidant, e.g., oxygen, is used to saturate a leach solution, e.g., aqueous carbonate solution, before the leach solution is introduced in a uranium-bearing formation to leach the uranium values. Well 10 is completed in a known manner with casing 11 of polyvinyl chloride pipe or the like. Perforations 12 are provided through casing 11 adjacent the formation 13 to be treated to allow liquid to flow from casing 11 into formation 13. Although perforations 13 are shown for illustration, the interval of well 10 adjacent formation 13 could be completed with screen or slotted liners as is well known in the art.

Conduit 14 is adapted to be connected to line 15 which in turn is connected to a source of gas, e.g., oxygen. Conduit 14 normally extends from the surface to a point slightly above perforations 12. Mixing apparatus 16 is affixed to the lower end of conduit 14.

Referring to FIGS. 2, 3, and 4, mixing apparatus 16 is comprised of solid plate 17 having a diameter slightly less than the diameter of casing 11 and having a central opening 18 therethrough. If the treating operation, i.e., uranium leaching, is such that the fluids used are highly corrosive, plate 17 is preferably made from a noncorrosive material, e.g., polyvinyl chloride. Plate 17 has a plurality of additional openings 19 therethrough which surround central opening 18. Gasket 20, e.g., rubber gasket, having a diameter substantially equal to the diameter of casing 11 is attached to plate 17 by means of screws 21 (FIG. 4) or the like. Gasket 20 has openings **18*a* and 19*a* (FIG. 4) which align with openings 18 and 19, respectively, through plate 17 when gasket 20 is affixed to plate 17**.

The lower end of conduit 14 is affixed into central opening 18, preferably by mating threads on the conduit and opening 18. However, it is recognized that other means, e.g., cementing, swedge fit, etc., could also be used to affix conduit 14 into opening 18. By solidly affixing plate 17 to the lower end of conduit 14, mixing apparatus 16 can easily be positioned in and removed from casing 11 by merely raising or lowering conduit 14. This is important since there likely will be instances during a treating operation where mixing apparatus 16 and conduit 14 will have to be removed and then replaced in well 10.

The simplicity of the present invention allows mixing apparatus 16 to be constructed at a minimal cost. For example, in many known uranium leach operations, the diameter of the injection wells is 4 inches. For these wells, a standard commercially available 3½ inch, polyvinyl chloride flange can be used as plate 17. The flange is already provided with a threaded ½-inch central opening 18 and the additional ½-inch openings 19 are easily drillable therethrough. A ¼-inch thick rubber gasket 20 having a 4-inch diameter is screwed onto the upper surface of plate 17 and openings are cut therethrough to correspond to the openings 18, 19 in plate 17. Conduit 14 is then threaded into central opening 18 and mixing apparatus 16 is ready to be lowered into the well.

The operation of mixing apparatus 16 is based on the same theory as that of the mixing devices disclosed in copending U.S. applications Ser. No. 846,863 and Ser. No. 846,874, both filed Oct. 31, 1977. That is, mixing apparatus 16 is attached to conduit 14 and is lowered into well 10 to a point slightly above (e.g., 30 to 50 feet) perforations 12 which, in turn, lie adjacent formation 13 to be treated. Liquid, e.g., carbonate leach solution, is pumped by pump 25 or the like through line 26 into the annulus formed between conduit 14 and casing 11. Liquid flows into a mixing zone 31 (FIGS. 1 and 2) through openings **19*a* in gasket 20 and openings 19 in plate 17** thereby substantially increasing the flow velocity of the liquid as it passes through these openings.

Meanwhile, gas, e.g., oxygen, is simultaneously flowed to mixing zone 31 through conduit 14 and exits in the form of bubbles through central opening 18 into the liquid just below plate 17. Due to the increased flow velocity of the liquid as it passes through openings 19, the drag force on the gas bubbles is increased as they attempt to rise in the liquid. Further, the pressure drop across plate 17 decreases the effective buoyant force of the gas bubbles in the liquid. Together, these effects prevent the bubbles from passing upward through openings 19 in plate 17. Further, the seal between plate 17 and casing 11 provided by gasket 20 prevents the bubbles from passing upward around the perimeter of plate 17 so substantially all of the gas is trapped to form a gas pocket 30 in mixing zone 31 below plate 17.

The liquid flows through openings 19 in plate 17 and through gas pocket 30 in the form of high velocity "waterfalls" with gas bubbles becoming entrapped in the liquid. Part of this gas is dissolved into the liquid as the bubbles are formed and the remaining gas in the liquid is carried down by the "waterfalls" through and out of gas pocket 30. A column of froth 33 is formed by the impact of the liquid falling on the surface below gas pocket 30 and creates an area of extremely high interfacial surface area and liquid turbulence, thereby further promoting mass transfer of gas to the liquid to fully saturate same.

It can cearly be seen from the above description that the present invention provides a reliable but inexpensive apparatus for the downhole mixing of a gas and a liquid which when attached to the gas supply conduit is rugged enough to be easily run into and out of the well on the conduit. Also, the apparatus is easily constructed from commercially available, noncorrosive material and due to the manner of assembly, presents no welds or the like which can corrode to damage the structural integrity of the apparatus. Therefore, the present invention can be constructed and installed at low cost and has a long, trouble-free operational life even in highly corrosive environments.

We claim:

1. In combination with a well, an apparatus for mixing a gas and a liquid at a downhole location within said well, said apparatus comprising:

a conduit extending from the surface into said well and adapted to be connected at its upper end to a supply of said gas;

a mixing means affixed to the lower end of said conduit whereby said mixing means can be lowered into or raised from said well by said conduit, said mixing means comprising:

a plate having a diameter slightly less than the diameter of said well;

said plate having a central opening therethrough in which said lower end of said conduit is affixed, said conduit terminating at said plate;

said plate having a plurality of additional openings therethrough surrounding said central opening, said liquid flowing through said additional openings when said liquid is flowed down said well through the annulus formed between said conduit and the wall of said well; and means on said plate for forming a seal between said plate and the wall of said well when said mixing means is in an operable position within said well.

2. The apparatus of claim 1 wherein said conduit is affixed within said central opening by means of mating threads.

3. The apparatus of claims 1 or 2 wherein said means for forming a seal comprises:

a gasket having a diameter substantially equal to the diameter of said well, said gasket being secured to a face of said plate and having openings therethrough in alignment with said openings through said plate.

4. The apparatus of claims 1 or 2, wherein said plate is comprised of a noncorrosive material.

5. The apparatus of claims 1 or 2, wherein said plate is comprised of polyvinyl chloride.

* * * * *